US006007708A

United States Patent [19]

Allcock et al.

[11] Patent Number: 6,007,708

[45] Date of Patent: Dec. 28, 1999

[54] COLD DENSE SLURRYING PROCESS FOR EXTRACTING BITUMEN FROM OIL SAND

[75] Inventors: Geoff Allcock, Fort McMurray; Robert Siy, Edmonton; Jonathan Spence, Edmonton; Ken Sury, Edmonton, all of Canada

[73] Assignees: Alberta Energy Company Ltd.; AEC Oil Sands Limited Partnership; Athabasca Oil Sands Investments Inc.; Canadian Occidental Petroleum Ltd.; Canada Oil Sands Investments Inc.; Gulf Canada Resources Limited; Imperial Oil Resources, all of Calgary, Canada; Mocal Energy Limited, Tokyo, Japan; Murphy Oil Company Ltd.; Petro-Canada Inc., both of Calgary, Canada

[21] Appl. No.: 08/943,283

[22] Filed: Oct. 3, 1997

[51] Int. Cl.[6] ..... C10G 1/04

[52] U.S. Cl. ..... 208/391; 208/390

[58] Field of Search ..... 208/390, 331

[56] References Cited

U.S. PATENT DOCUMENTS

| | | | |
|---|---|---|---|
| 3,969,220 | 7/1976 | Anderson | 208/11 |
| 4,105,537 | 8/1978 | Mc Quitty | 208/11 |
| 4,111,789 | 9/1978 | Porteous | 208/11 |
| 4,401,552 | 8/1983 | Roth et al. | 208/11 LE |
| 4,946,597 | 8/1990 | Sury . | |
| 5,039,227 | 8/1991 | Leung et al. . | |
| 5,264,118 | 11/1993 | Cymerman et al. | 208/390 |
| 5,290,433 | 3/1994 | Chan | 208/391 |

FOREIGN PATENT DOCUMENTS 2029795 11/1989 Canada .

OTHER PUBLICATIONS

Dreding and Cold Water Extraction Process for Oilsands, W. Jazrawi, Esso Resources Canada Limited, The OSLO Consortium, Session 2, Paper No. 4, Mar. 1990.

*Primary Examiner*—Helane Myers
*Attorney, Agent, or Firm*—Millen, White, Zelano & Branigan, P.C.

[57] ABSTRACT

Average grade oil sand is mixed with water to produce a low temperature (20–35° C.), dense (1.4–1.65 g/cc) slurry. The slurry is pumped through a pipeline for sufficient time to condition it. Air is injected into the slurry after the last pump. The slurry density is adjusted to about 1.5 g/cc by adding flood water near the end of the pipeline. The slurry is introduced into a primary separation vessel slurry as it is introduced into the (PSV), excess air is vented from the PSV and a hot water underwash is used to heat the froth produced. Slurry loading to the PSV is greater than about 4.78 tonnes of oil sand/hour/square meter to reduce velocity gradient in the fluid in the vessel. Bitumen froth is recovered. When fed low grade oil sand, the process is modified by adding flotation aid chemicals to the slurry in the pipeline and subjecting the PSV tailings and middlings to secondary recovery with agitation and aeration in a secondary separation vessel.

24 Claims, 12 Drawing Sheets

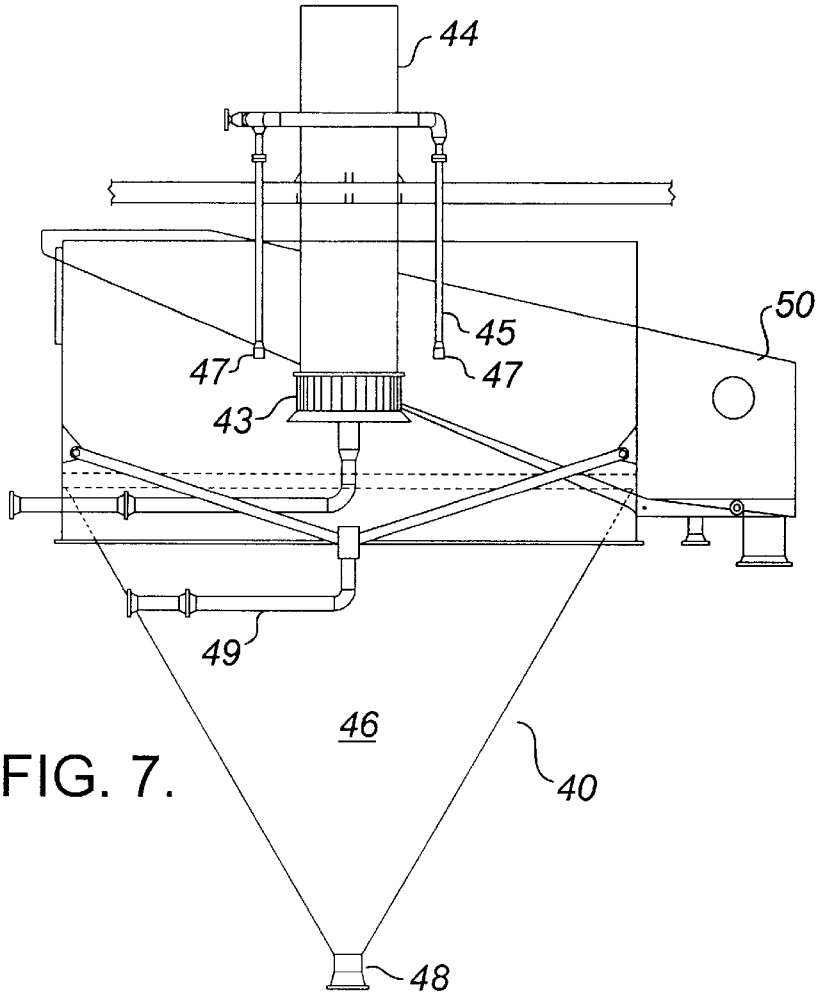
FIG. 7.
FIG. 8.
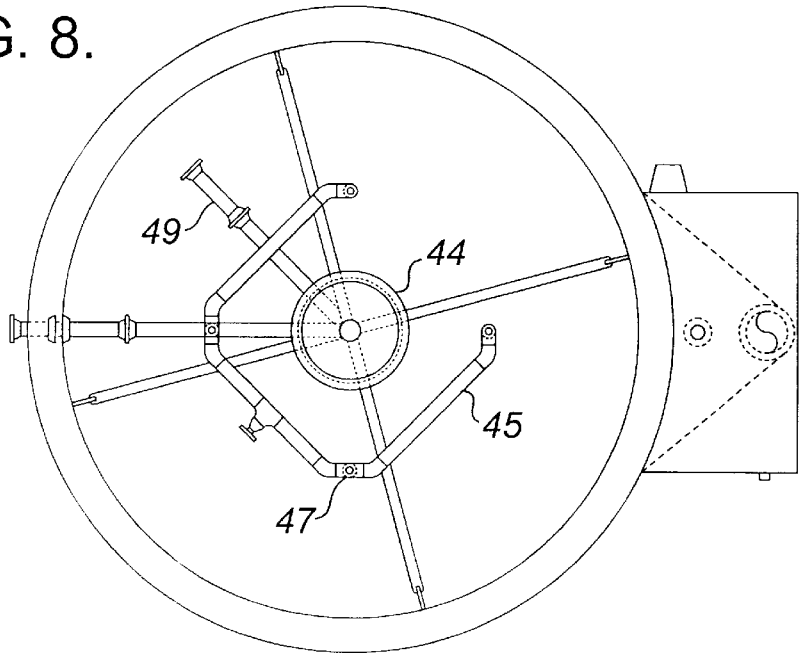

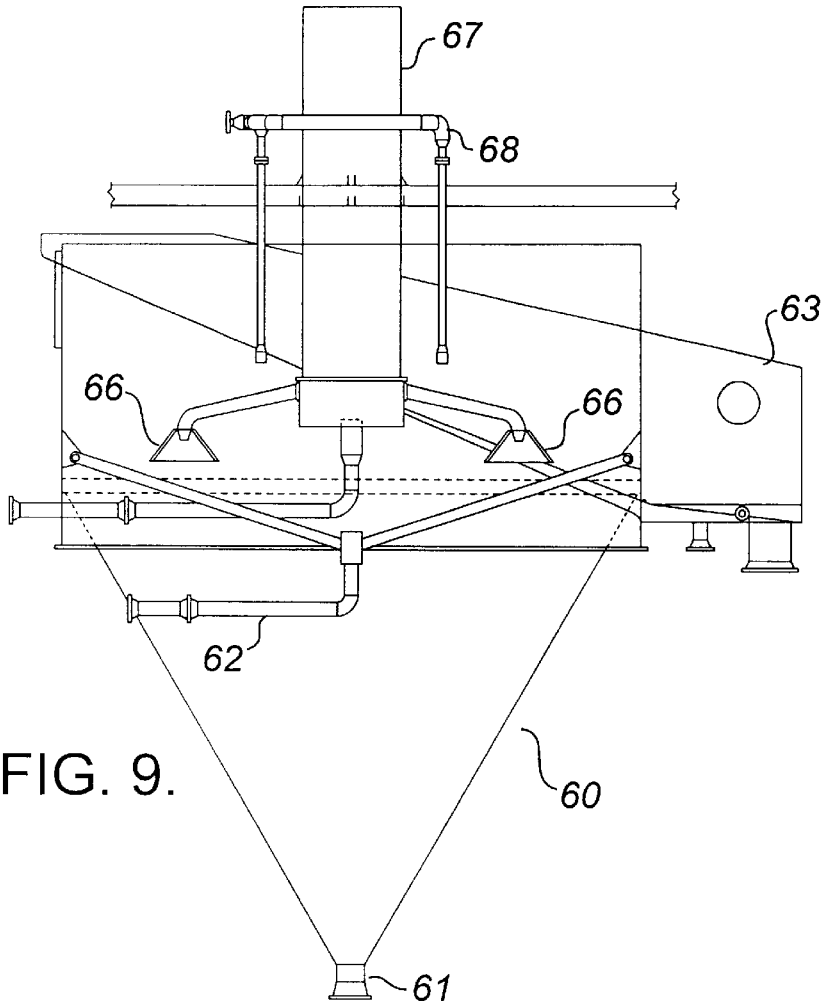
FIG. 9.
FIG. 9A.
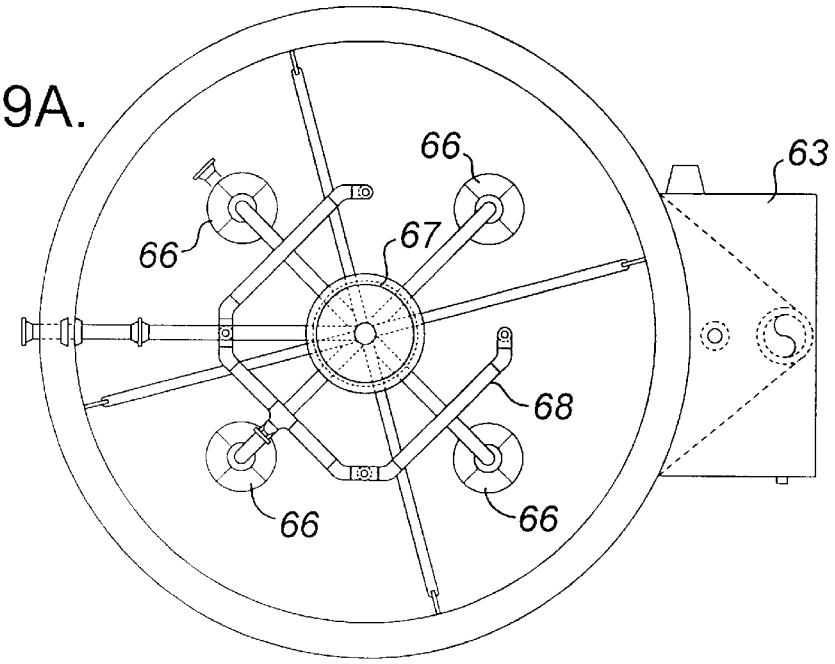

COLD DENSE SLURRYING PROCESS FOR EXTRACTING BITUMEN FROM OIL SAND

FIELD OF THE INVENTION

This invention relates to a method for extracting bitumen from oil sand. More particularly it relates to mixing oil sand with water to produce a dense, low temperature slurry, pipelining the slurry a sufficient distance to condition the slurry, aerating the slurry, feeding the aerated slurry to a primary separation vessel, maintaining a relatively low oil sand loading and venting excess air from the slurry as it is fed to the vessel, to cause flotation of the bitumen and gravity separation of the solids, to thereby recover bitumen in froth form.

BACKGROUND OF THE INVENTION

Oil sand, as known in the Fort McMurray region of Alberta, comprises water-wetted sand grains having viscous bitumen flecks trapped between the grains. It lends itself to separating or dispersing the bitumen from the sand grains by slurrying the as-mined oil sand in water so that the bitumen flecks move into the aqueous phase.

The bitumen in McMurray oil sand has been commercially recovered for the past 25 years using the following general scheme (referred to as the "hot water process"):

- dry mining the oil sand at a mine site that can be kilometers from an extraction plant;
- conveying the as-mined oil sand on conveyor belts to the extraction plant;
- feeding the oil sand into a rotating tumbler where it is mixed for a prescribed retention time with hot water (80° C.), steam, caustic and naturally entrained air to yield a slurry typically having a temperature of 80° C. The bitumen flecks are heated and become less viscous. Chunks of oil sand are ablated or disintegrated. The sand grains and bitumen flecks are dispersed or separate in the water. To some extent bitumen flecks coalesce and grow in size. They may contact air bubbles and coat them to become aerated bitumen. The term used to describe this overall process in the tumbler is "conditioning";
- the slurry produced is then diluted with additional hot water and introduced into a large, open-topped, conical-bottomed, cylindrical vessel (termed a primary separation vessel or "PSV"). The diluted slurry is retained in the PSV under quiescent conditions for a prescribed retention period. During this period, the aerated bitumen rises and forms a froth layer which overflows the top lip of the vessel and is conveyed away in a launder; and the sand grains sink and are concentrated in the conical bottom—they leave the bottom of the vessel as a wet tailings stream. Middlings, a watery mixture containing solids and bitumen, extend between the froth and sand layers. The tailings and middlings are withdrawn, combined and sent to a secondary flotation process carried out in a deep cone vessel wherein air is sparged into the vessel to assist with flotation. This vessel is referred to as the TOR vessel. It and the process conducted in it are disclosed in U.S. Pat. No. 4,545,892, incorporated herein by reference. The bitumen recovered is recycled to the PSV.

The middlings from the deep cone vessel are further processed in air flotation cells to recover contained bitumen.

It is important to note that the process temperature in the tumbler and PSV is in the order of 80° C. This high slurry temperature is used to reduce the bitumen viscosity sufficiently so that it will readily separate from the sand and coat the air bubbles in the aeration process. It also serves to enhance the density difference between bitumen and water, which leads to more effective flotation separation. The high temperature also promotes faster disintegration of the oil sand lumps in the tumbler and faster coalescence of the bitumen flecks in the PSV.

It is well understood in the industry that the quality of the oil sand has very significant effects on the completeness of primary bitumen recovery in the PSV and the quality of this froth (the froth from the PSV is termed "primary" froth - that from the secondary circuit is termed "secondary" froth). The quality of the useful oil sand produced from a mine will vary in grade. The present invention is directed to establishing processes which are capable of treating "low grade" and "average" oil sands to yield viable bitumen recovery and froth quality at a lower energy input than the current commercial processes. A "low grade" oil sand will contain between about 7 and 10 wt. % bitumen. An average oil sand will contain at least 10 wt. % bitumen, typically around 11 wt. %.

To be useful, a new or modified process for extracting bitumen from low grade and average oil sands should achieve a total recovery value falling within the extraction recovery curve set forth in FIG. 1.

A fairly recent and major innovation in the oil sand industry has involved:

- supplying heated water at the mine site;
- mixing the dry as-mined oil sand with the heated water at the mine site in predetermined proportions using a device known as a "cyclofeeder", to form a slurry of controlled density having a temperature in the order of 50° C.;
- screening the slurry to remove oversize solids too large to be fed to the pipeline;
- pumping the screened slurry to the extraction plant through several kilometers of pipeline; and
- feeding the slurry directly into the PSV. This procedure relies on:
- the cyclofeeder successfully mixing the oil sand with the water in pre-determined proportions at high rates while simultaneously entraining some air within the slurry, thereby producing an aerated slurry having a predetermined density; and
- the pipeline providing ablation and retention time during which oil sand lumps are disintegrated and bitumen flecks coalesce and coat or attach to the air bubbles, so that the slurry is conditioned and ready to go directly into the PSV and yield the required viable froth yield and quality.

This innovation is disclosed in Canadian Patent No. 2,029,795 (Cymerman et al) and U.S. Pat. No. 5,039,227 (Leung et al), both assigned to the present assignees and incorporated herein by reference.

The cyclofeeder operates on the principle of recycling part of the produced slurry and introducing it tangentially into the vessel to produce a vortex. The oil sand is delivered into the vortex. Water is added to the vortex, to maintain the consistency of the slurry. An alternative to the cyclofeeder is the trough system described in U.S. patent application Ser. No. 08/787,096, also incorporated herein by reference.

The innovation has enabled remote satellite mines to feed a central extraction plant and has substantially eliminated conveyors and tumblers from the process equipment.

Another innovation was developed by the OSLO group of companies. This process involves:

mixing oil sand with unheated water at the mine site using a dredging procedure to produce a low density, ambient temperature slurry;

pumping this slurry through a pipeline to an extraction plant;

adding air (1 to 1.5 volumes of air/volume of slurry) to the slurry in the pipeline; and adding flotation aid chemicals (specifically a collector having the characteristics of kerosene and a frother having the characteristics of methyl-isobutyl-carbinol ("MIBC") ) to the slurry while in the pipeline to assist in later flotation in a PSV.

This process is disclosed in a paper "Dredging and cold water extraction process for oil sands" by W. Jazrawi, delivered at a seminar convened in March, 1990, by the Alberta Oil Sands and Technology Authority and U.S. Pat. No. 4,946,597 (K. N. Sury).

The OSLO process differs from the commercial hot water process and the mixing/pipelining process in that it is carried out at ambient temperature. Water at ambient temperature is used for slurry instead of expending energy to heat water and then having to convey the hot water to the mine site in an insulated pipeline.

The Jazrawi paper describes testing slurries having densities of 25 wt. % and 50 wt. % by weight solids in a pipeline test facility. However, the stated slurrying process, dredging, offers little control over slurry density and no control over temperature. Dredged oil sand slurry typically has a density in the order of 1.2 to 1.3 g/cc. At this order of density, the process may lose viability as a large volume of slurry has to be moved through the line and processed to treat a specific quantity of oil sand. In addition the oil sand loading of the PSV surface area will necessarily be low, leading to the need for a very large PSV surface area.

The OSLO process also differs from the hot water process in that it is thought that the bitumen flecks tend to attach to the air bubbles, rather than coating them. The intimation is that, at low temperature, the bitumen is solid-like rather than fluid in nature. The flotation aid chemicals are provided to enhance the attachment mechanism. The Jazrawi paper indicates that the dosage of flotation chemicals should increase as the grade of the oil sand decreases.

With this background in mind, the present invention is now described.

SUMMARY OF THE INVENTION

In one broad aspect, the invention provides a process for extracting bitumen from an average oil sand, comprising:

dry mining the oil sand;

mixing the as-mined oil sand with water in predetermined proportions near the mine site to produce a slurry containing entrained air and having a controlled density in the range 1.4 to 1.65 g/cc and a temperature in the range 20–35° C.;

pumping the slurry through a pipeline having a plurality of pumps spaced along its length, the pipeline being connected to feed a primary separation vessel ("PSV");

preferably adding air to the slurry as it moves through the pipeline, more preferably after the last pump, in an amount up to 2.5 volumes of air per volume of slurry, to form an aerated slurry;

introducing the slurry into the PSV, preferably so as to provide an area loading greater than about 4.78 tonnes of oil sand/hour square meter, more preferably in the range of about 4.78 to 9.91 t/h/m$^2$ and producing bitumen froth, tailings and middlings; and separately removing the froth, tailings and middlings from the PSV.

Inherent in the process defined by this broad statement, the following concepts are brought together:

the oil sand is dry mined and mixed at the mine site with water using means such as a cyclofeeder to produce a dense slurry having a low temperature;

if the oil sand is of average or higher grade, we have discovered that it can be pipelined in the form of a dense, low temperature slurry, preferably with added aeration but without addition of flotation aid chemicals, and then subjected to flotation in a PSV to give viable primary bitumen recovery in the form of froth having viable quality; and the dense, low temperature slurry can be fed at loading in the order of about 4.78–9.91 t/h/m$^2$ into the PSV and still produce the desired froth, thereby maintaining the high density nature of the process.

Preferably, one or more of the following features are incorporated into the basic process:

operating the slurrying and pipelining steps at a density in the order of about 1.6 g/cc and a temperature in the order of 25° C.; maintaining the slurry area loading to the PSV within generally defined limits to ensure a vessel of adequate diameter so as to facilitate bitumen flotation;

pumping the slurry through a pipeline having sufficient length so that the retention time is at least 4 minutes, to achieve conditioning;

adjusting the density of the flotation step by adding flood water to the slurry as it approaches the PSV to reduce its density to less than 1.5 g/cc;

venting excess air from the slurry as it is being introduced into the PSV through a vent stack associated with the incoming feed distributor; and adding sufficient heated water as an underwash layer between the froth and middlings in the PSV to ensure production of froth having a temperature greater than about 35° C.

Inherent in the preferred process are the concepts of:

operating the slurrying and pipelining steps at low temperature and high density; and then moderating density at the PSV, if required, to promote effective flotation; maintaining slurry loading within limits to promote effective flotation;

using an underwash of hot water to heat the froth and enable it to flow more easily; and modifying the PSV step to cope with the large air content in the slurry and minimize turbulence.

The best mode of the invention will be described below by way of reporting on experimental tests.

The tests have demonstrated that:

a well mixed, high density, low temperature slurry of average quality oil sand, will condition adequately in a pipeline so as to yield viable primary recovery of bitumen in the form of froth of viable quality, particularly if the steps of air addition, excess air venting, slurry dilution and slurry loading are incorporated, without the addition of flotation aid chemicals, and the froth can be heated to at least 35° C. by use of a hot water underwash in the PSV, thereby assisting in removing the froth from the PSV and satisfying downstream froth temperature needs.

In another aspect of the invention, we have shown that the process as previously described can successfully be applied to low grade oil sand, provided that:

flotation aid chemicals are added to the slurry in the pipeline; and secondary recovery of bitumen by way of flotation with agitation and submerged aeration is practiced.

We have further found that use of the OSLO flotation aid mixture of a collector (such as kerosene) and a frother (such as MIBC), works satisfactorily with the low temperature, dense slurry and air addition to create a slurry which, when subjected to pipeline conditioning, primary quiescent flotation and secondary agitated and sub-aerated flotation, yields enough bitumen recovery to satisfy the curve of FIG. 1.

Broadly stated, the invention is a method for recovering bitumen from oil sand, comprising: dry mining oil sand from a deposit at a mine site; mixing the oil sand near the mine site with water to produce a high density, low temperature slurry containing bitumen, sand, water and entrained air, the slurry having a density in the range of about 1.4 to 1.65 g/cc and a temperature in the range of about 20 to 35° C.; pumping the slurry through a pipeline to a primary separation vessel; introducing the slurry from the pipeline into the vessel and temporarily retaining it therein so that separate layers of bitumen froth, middlings and sand tailings are formed; and separately removing bitumen froth, middlings and sand tailings from the vessel.

DESCRIPTION OF THE DRAWINGS

FIG. 7 is a side elevation of the primary separator vessel ("PSV") used in the 100 tph circuit;

FIG. 8 is a top plan view of the primary separator of FIG. 7;

FIG. 9 is a side elevation of a second smaller separator ("SSV") used in the 100 tph circuit to test secondary recovery slurry loading;

FIG. 9*a* is a top plan view of the SSV of FIG. 9;

DESCRIPTION OF THE PREFERRED EMBODIMENT

EXAMPLE I

Pilot Demonstration

This example describes a run in a 100 tonne per hour of oil sand field pilot circuit at optimum conditions, demonstrating the viability of the best mode of the process when applied to average grade oil sand.

Summary

The feedstock was average grade oil sand containing 11.1 wt. % bitumen and 6% fine solids<44 $\mu$m. The process involved mixing of the oil sand and water in a cyclofeeder to produce a slurry having a density of about 1.55 g/cc. The temperature of the slurry was 26–27° C. The slurry was conditioned by pumping it through a 102 mm diameter pipeline having a length of 1.1 kilometers and retention time of about 4 minutes. Air was added to the slurry in the pipeline just before the PSV to provide an air to slurry volume ratio of about 1.5. The slurry was diluted with flood water prior to entering the PSV to modify the density to 1.4 g/cc. Hot water (80° C.) was injected as an underwash and raised the froth temperature to 33° C., adequate for subsequent processing. The oil sand loading of the PSV was about 4.78 tonne/hr./m$^2$.

Results

The average recovery achieved was about 98% bitumen on a reject free basis, with a bitumen primary froth quality of about 59% bitumen, 21% water and 20% solids based on weight.

Equipment and Conditions

Figure 1:
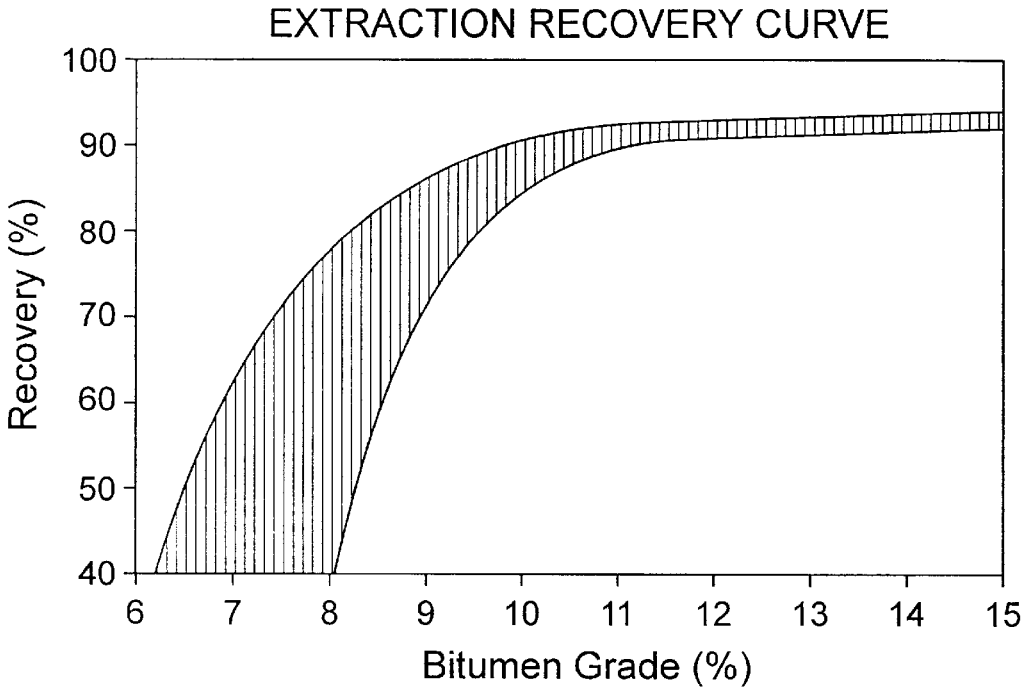
FIG. 1 is a curve in the form of a band, showing viable bitumen recoveries for various grades of oil sand.
Figure 2:
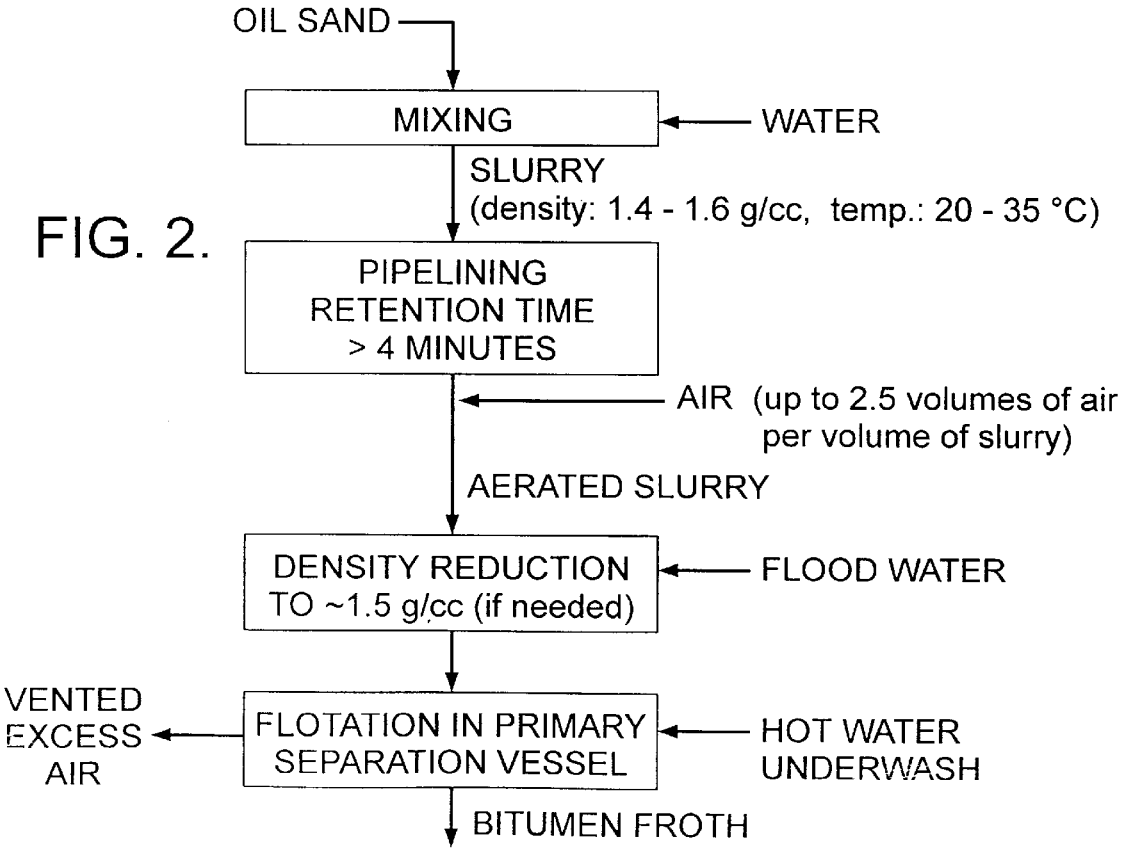
FIG. 2 is a block diagram setting forth the process in accordance with the invention, for use on average or higher grade oil sand feedstock.
Figure 3:
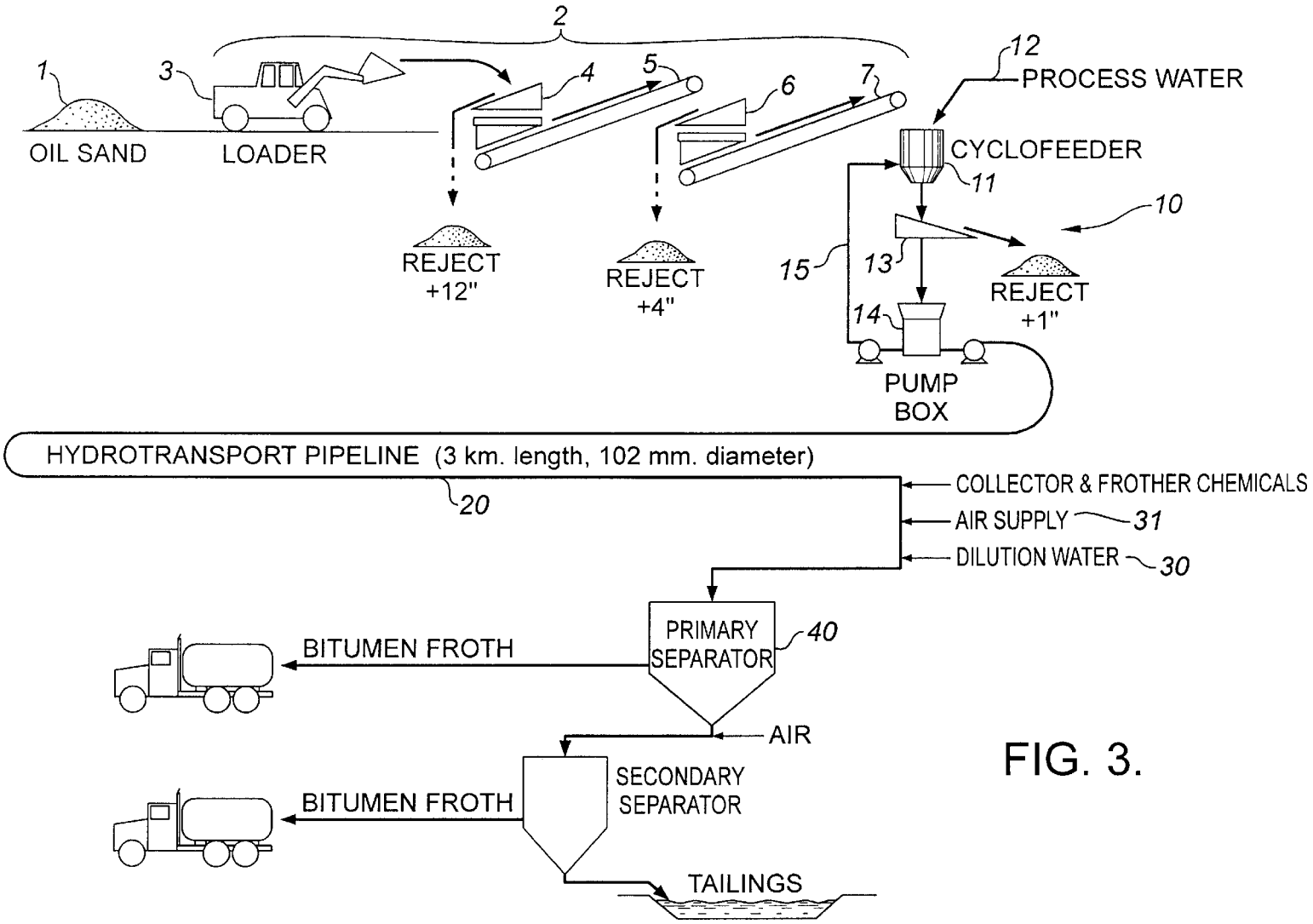
FIG. 3 is a schematic process flow diagram of a 100 tonne/hour field pilot circuit (hereinafter "100 tph circuit") used to demonstrate the average grade version of the process.
Figure 5:
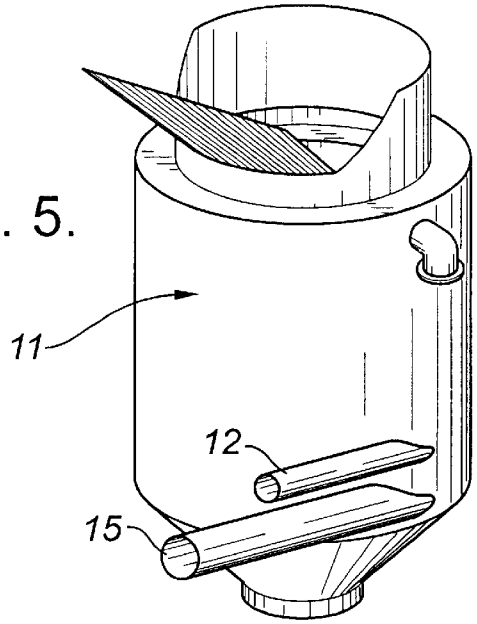
FIG. 5 is a perspective view of the cyclofeeder of FIG. 4.
Figure 6:
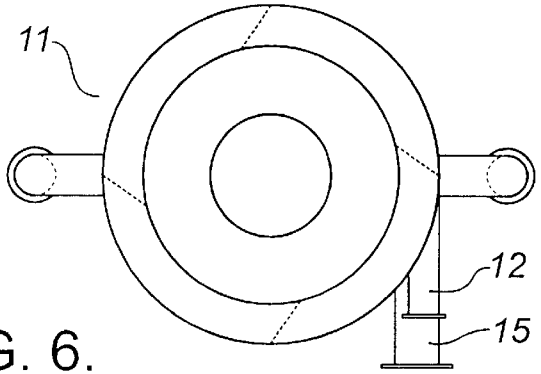
FIG. 6 is a top plan view of the cyclofeeder of FIG. 4.
Figure 4:
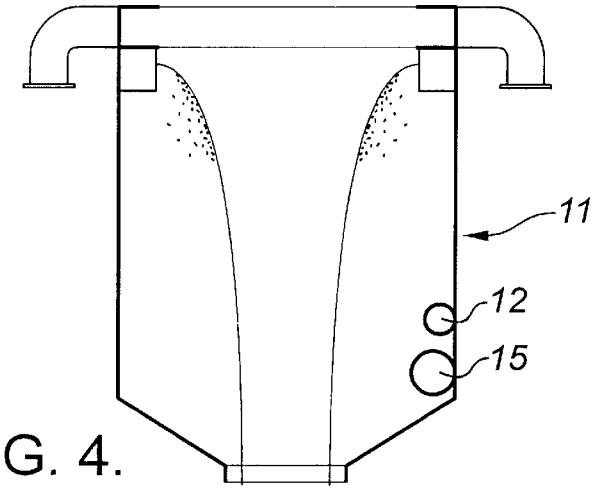
FIG. 4 is a side elevation of the cyclofeeder used in the 100 tph circuit.
Figure 10:
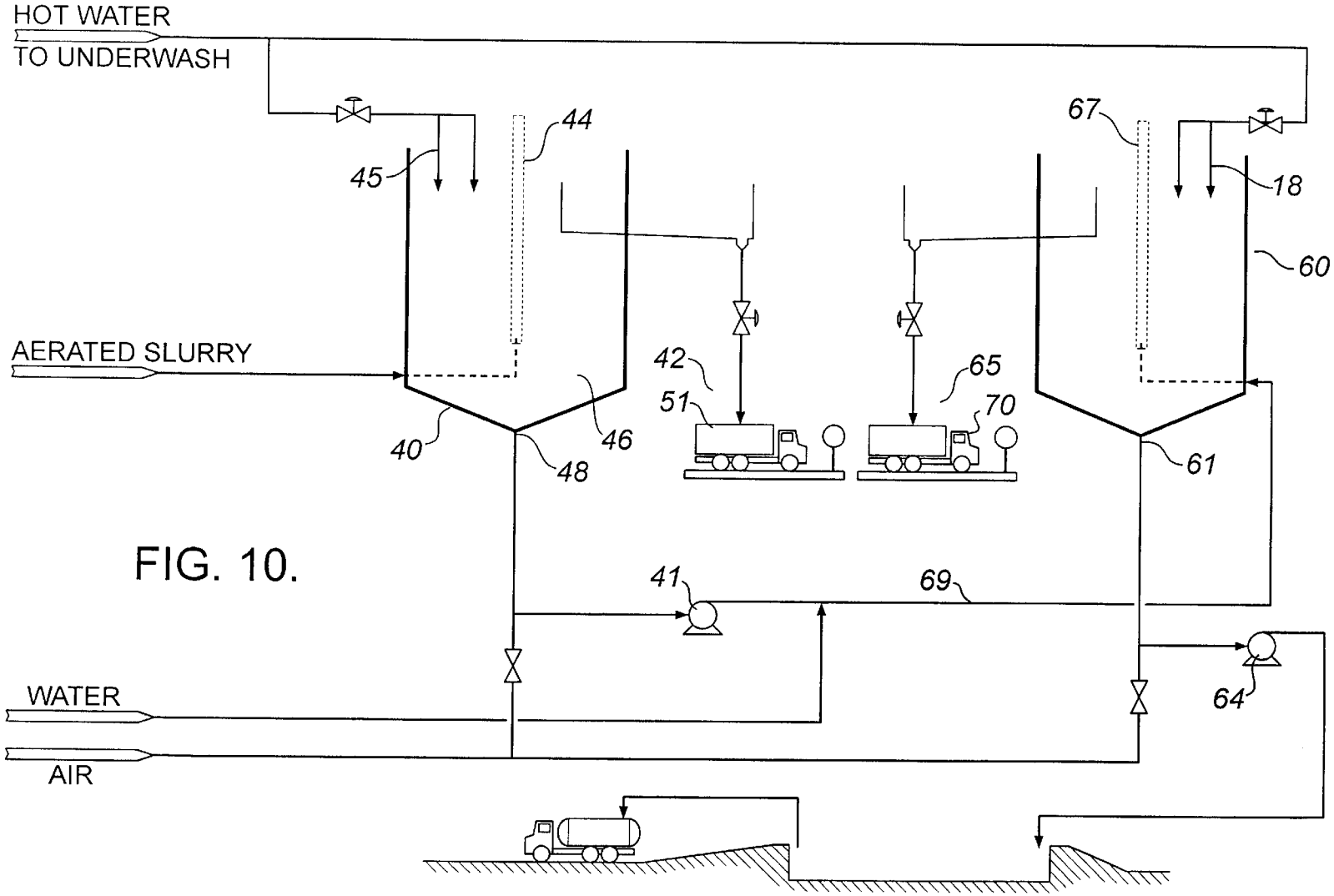
FIG. 10 is a schematic process flow diagram showing the PSV and SSV and the piping connected thereto.
Figure 11:
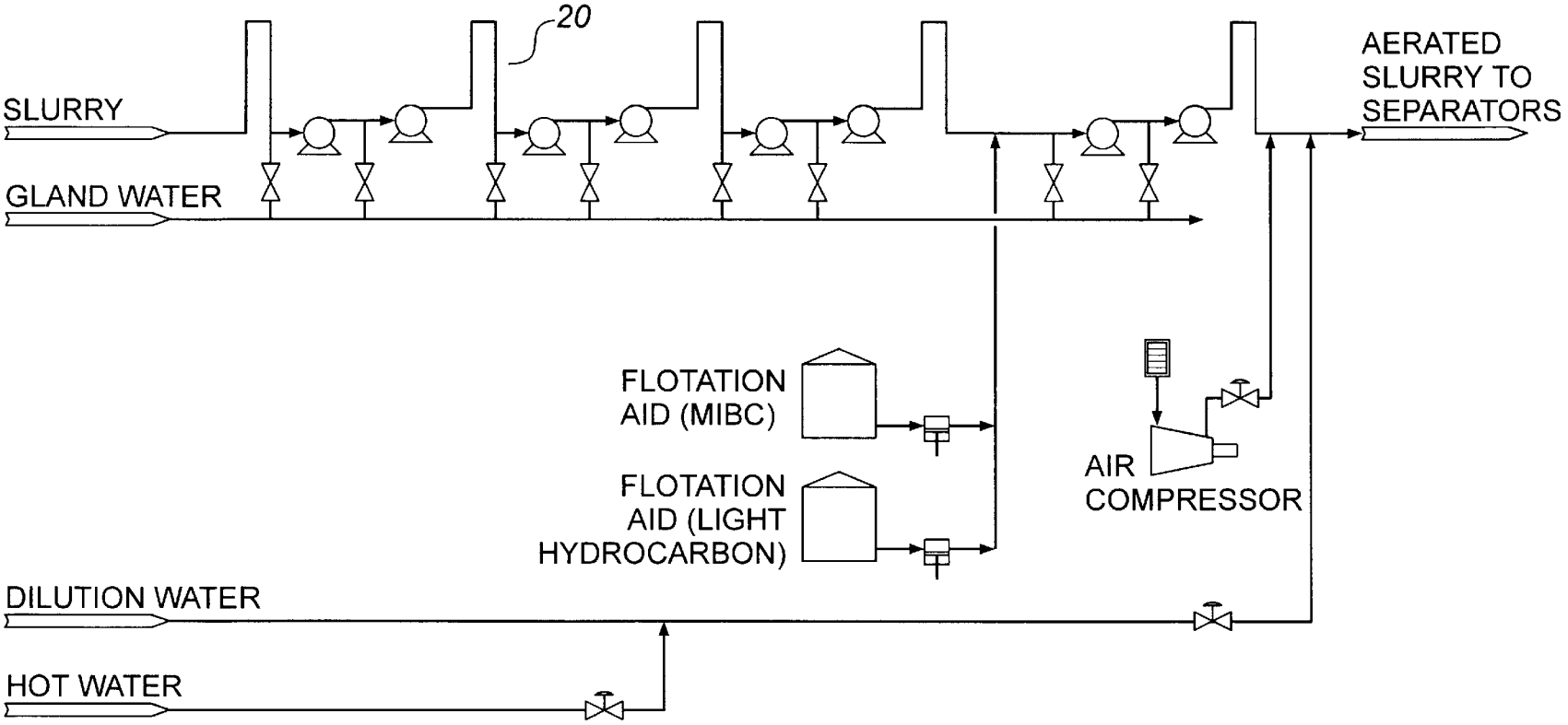
FIG. 11 is a schematic process flow diagram showing the pipeline assembly used in the 100 tph circuit.
Figure 12:
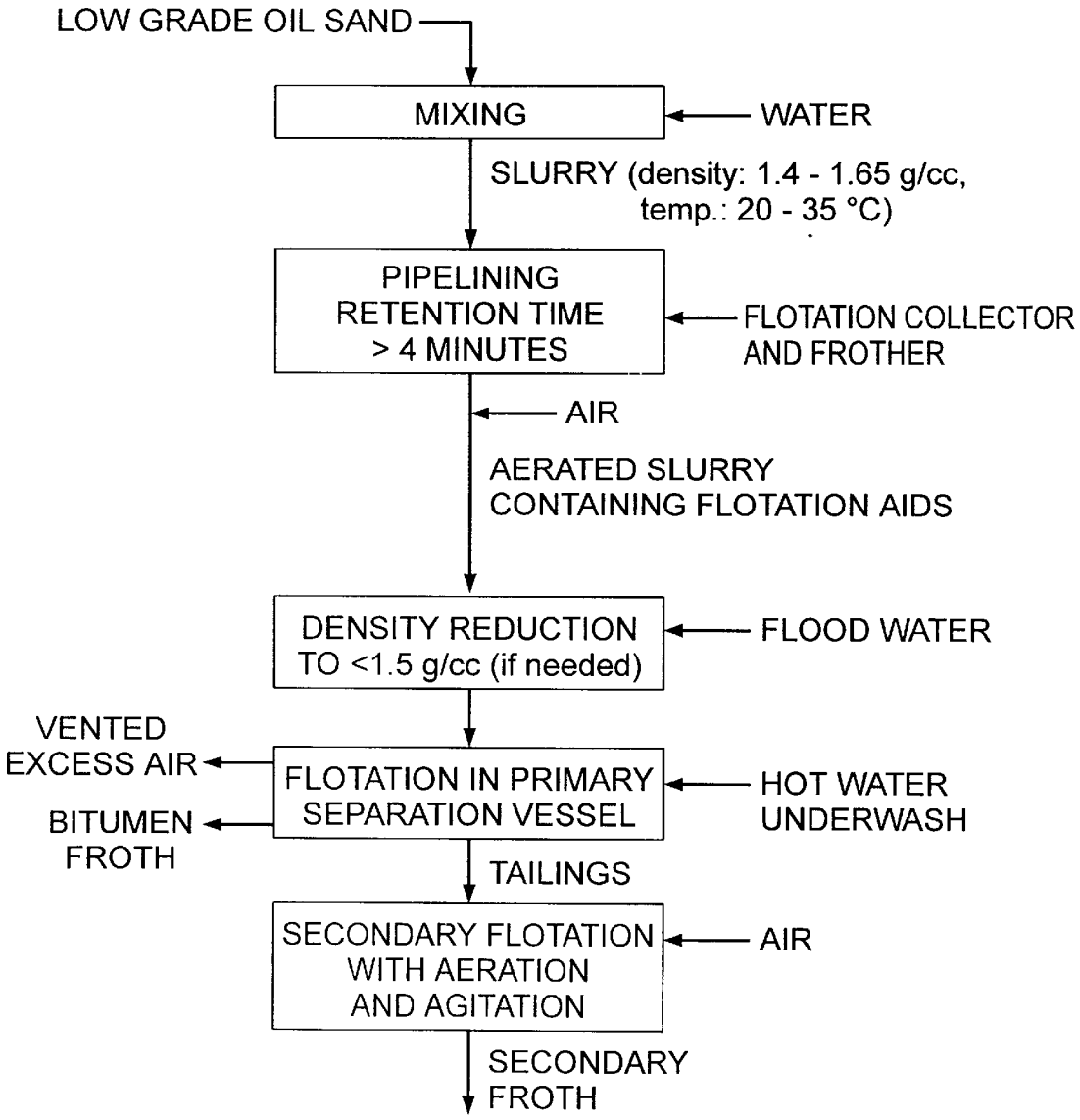
FIG. 12 is a block diagram setting forth the process in accordance with the invention, when practiced on low grade oil sand.

The 100 tph circuit is shown in FIG. 3. It comprised:

A pile 1 of as-mined oil sand;

An oil sand feed system 2 comprising a front end loader 3, vibrating grizzly 4 for screening out or rejecting+12 inch lumps, a conveyor 5 for transporting the −12 inch oil sand, a second vibrating grizzly 6 for receiving the −12 inch oil sand and rejecting the+4 inch material and a feed conveyor 7 for transporting the screened undersize to the cyclofeeder;

A cyclofeeder system 10 comprising a cyclofeeder 11, a source 12 of process water for supplying the cyclofeeder, a vibrating screen 13 for rejecting+1 inch oversize from the underflow from the cyclofeeder and a pump box 14 for collecting the cyclofeeder underflow. This cyclofeeder system 10 is described in U.S. Pat. No. 5,039,227. The cyclofeeder is shown in FIGS. 4, 5 and 6. The cyclofeeder system 10 is operative to mix oil sand and water, in pre-determined proportions, to create an oil sand slurry having a controlled or pre-determined density. Some air is entrained in the slurry during mixing. The cyclofeeder 11 was 1200 mm in diameter, 1200 mm in height, and had a bottom cone opening of 330 mm. It discharged slurry onto a vibrating screen 13 having a single deck (0.9 m by 3.0 m) of woven wire mesh having an opening size of 25 mm. Hot water at 80° C. was sprayed onto the screen to prevent blinding. Slurry was pumped and recycled from the pump box 14 to the cyclofeeder 11 through line 15 to maintain a steady vortex in the cyclofeeder. The weight ratio of recycle flow to pipeline flow was approximately 3:1;

A slurry pipeline 20, shown in FIGS. 3 and 11. It was designed to operate at an oil sand feed rate from 75 to 100 t/h. It consisted of a series of six sections, with a total length of up to 3 km. Two pumps 21 powered each section. The slurry velocity within the pipeline was between 2.5 and 3.5 m/s;

An air and dilution water addition system. Air from a compressor 31 was injected into the slurry about 360 meters before the end of the pipeline through a 37 mm diameter nozzle having 5 mm diameter orifices. The diameter of the pipeline at the air injection point was increased to 150 mm to accommodate the increased stream volume. Flood water was also added, if required, from a source 30 to the slurry just downstream of the air addition point, to modify the slurry density. The diluted and aerated slurry was retained in the pipeline for about 2 minutes following addition;

A primary separation vessel 40 ("PSV"). This vessel is shown in FIGS. 7 and 8. Associated with it were an underflow pump 41 and a froth weighing system 42. The PSV had a diameter of 5.18 m in the cylindrical section. The vessel was of the deep cone type (angle of cone 60°). The vessel had a central feed slurry distributor 43. This was a 0.92 m diameter pipe having openings in its side wall. A vent stack 44 extended up from the distributor, for venting excess air from the entering slurry, to reduce turbulence. A froth underwash pipe 45 extended down into the vessel chamber 46 and extended horizontally around the vent stack just below the expected level of the froth/middlings interface. The froth underwash ("U/W") pipe had four outlets 47 for injecting heated underwash water into the vessel chamber. The froth U/W pipe vertically entered the PSV 1295 mm from the vessel center. The feedwell radius was 460 mm and the vessel radius was 2590 mm. The water exited the outlets 47 870 mm below the froth overflow lip elevation. The froth/middlings interface generally stayed 250 to 500 mm above the U/W outlets 47. The tailings left the vessel through a bottom outlet 48 Middlings could be withdrawn through pipe 49—however this was not done during the tests described herein. The froth overflowed into a launder 50 and was conveyed into the box of a truck 51 standing on a weigh scale for measuring froth production rate;

A secondary separation vessel 60 ("SSV"). This vessel is shown in FIGS. 9 and 9*a*. The SSV has been shown because it was used in a vessel loading experiment described hereunder. It was also operated in these runs, but was found to be unnecessary because its recovery was negligible. It was also a deep cone vessel having similar internals to the PSV. It was smaller, being 3.66 m in diameter and having a cone angle of 60°. It was equipped with a tailings outlet 61, middlings removal pipe 62, launder 63, underflow pump 64, froth weighing means 65, slurry distributor 66, vent stack 67, and underwash pipe 68, substantially in accordance with the PSV. The underflow slurry from the PSV was mixed with air in line 69 using an in-line aeration nozzle similar to that of the pipeline 20. The PSV underflow slurry was conditioned through 180 meters of 150 mm diameter line 69 and then introduced into the SSV for additional bitumen recovery. The underflow from the SSV was discarded in a pit. The froth produced was deposited into the box of a truck 70 standing on a weigh scale;

The pilot plant was equipped with instrumentation to measure flow rate, temperature and density of all process streams The signals from the instruments were fed to an Allen Bradley 5/40 E Programmable Logic Controller ("PLC"), which was used for all process control functions except oil sand and chemical rate control. A Man Machine Interface ("MMI"), comprising a PC based system using Intellution Fix DMACS, was provided for data logging and trending. A Ramsey mechanical belt weigh scale was used to measure oil sand feed rate to the cyclofeeder. Samples were taken of the following streams for material balances: oil sand; cyclofeeder screen rejects; pipeline exit slurry; PSV froth; PSV underflow; SSV froth; and SSV underflow. Samples were analyzed for density, OWS, PSD, froth aeration and froth viscosity.

Conditions and Results

The conditions and averaged results of a series of 6 runs are now set forth in Tables I and II, now set forth.

TABLE I

DEMONSTRATON RUN CONDITIONS - AVERAGE GRADE OIL SAND

| | | |
|---|---|---|
| Oil Sand Feed | t/h | 101 |
| Pipeline Length | Km | 1.1 |
| Pipeline: No. of Pumps | | 6 |
| 4" Pipeline Inlet temperature | ° C. | 26 |
| 4" Pipeline Outlet temperature | ° C. | 27 |
| 4" Pipeline Velocity | m/s | 3.0 |
| 4" Pipeline Feed Density | kg/m3 | 1548 |
| Pipeline Air to Slurry Ratio | vol/vol | 1.5 |
| MIBC | ppm oil sand | 0 |
| Hydrocarbon additive | ppm oil sand | 0 |
| Vessel Selection (PSV,SSV) | | PSV |
| Separation Circuit | | PSV only |
| PSV Feed Density, excluding Air | kg/m3 | 1402 |
| PSV Slurry Feed Temperature | ° C. | 24 |
| PSV Underwash/Oil Sand Ratio | % | 8 |
| PSV Underflow Density, exc. Air | kg/m3 | 1410 |
| SSV Air to Slurry Ratio | vol/vol | 1 |
| SSV Slurry Feed Temperature | ° C. | 29 |
| SSV Underwash/Oil Sand | % | 6 |

TABLE II

Demonstration Results - Average Grade Oil Sand

| | | |
|---|---|---|
| Rejects (Based on Oil Sand Rate) | % | 2.5 |
| Rejects Bitumen Loss (Based on Oil Sand Feed) | % | 1.4 |
| PSV Bitumen Recovery (Based on PSV Feed) | % | 98.1 |
| PSV Froth Bitumen | % | 59.1 |
| PSV Froth Solids | % | 20.2 |
| PSV Underflow Bitumen Loss (Based on PSV Feed) | % | 1.9 |
| PSV Underflow Bitumen | % | 0.1 |
| PSV Underflow Solids | % | 46.7 |

The foregoing data provide the conditions used and results obtained in a group of runs which were averaged, the runs having been carried out on average oil sand at selected conditions in the pilot plant. A number of other runs were carried out with varied conditions and are supported by a substantial body of experimentation at laboratory bench and 2 tonne/hour pilot scales. From this overall program, we have established:

That the density of the mixed slurry introduced into the pipeline should be in the range 1.4 to 1.65 g/cc. If the density is less than about 1.4 g/cc, the system has reduced oil sand capacity. If the density is greater than about 1.65 g/cc, the pipeline operation is characterized by high head loss and a potential for sanding out and plugging;

That the temperature of the mixed slurry issuing from the pipeline should be in the range 20–35° C. If the temperature is less than about 20°, bitumen recovery will be lower. If the temperature is greater than about 35° C., the system is wasting energy;

That the aeration ratio should be up to about 2.5, preferably 1–2.5, volumes of air per volume of slurry. If the ratio is less than 1, bitumen recovery may be reduced. There is no improvement if the ratio is increased above 2.5.

EXAMPLE II

Effects of Chemical Addition

This example demonstrates that the process of the invention can be practised on average oil sand without the use of flotation aids to yield viable bitumen recovery as primary froth of viable quality.

The pilot circuit described in Example I was used.

Runs with and without flotation aid chemicals were carried out for comparison. The relevant conditions and results are set forth in Table III now following:

TABLE III

EFFECTS OF CHEMICAL ADDITION - AVERAGE GRADE OIL SAND

| | | |
|---|---|---|
| MIBC, ppm oil sand | 0 | 33 |
| Hydrocarbon additive, ppm oil sand | 0 | 27 |
| 4" Pipeline Inlet Temperature, ° C. | 26 | 25 |
| 4" Pipeline Outlet Temperature, ° C. | 27 | 27 |
| 4" Pipeline Feed Density, kg/m3 | 1548 | 1526 |
| Pipeline Air to Slurry Ratio, vol/vol | 1.5 | 1.5 |
| PSV Feed Density, excluding Air, kg/m3 | 1402 | 1402 |
| Rejects (Based on Oil Sand Rate), % | 2.5 | 11.8 |
| Rejects Bitumen Loss (Based on Oil Sand Feed), % | 1.43 | 7.10 |
| PSV Bitumen Recovery (Based on PSV Feed), % | 98.1 | 97.8 |
| PSV Froth Bitumen, % | 59.1 | 62.0 |
| PSV Froth Solids, % | 20.2 | 18.9 |
| PSV Underflow Bitumen Loss (Based on PSV Feed), % | 1.9 | 2.2 |
| PSV Underflow Bitumen, % | 0.1 | 0.1 |
| PSV Underflow Solids, % | 46.7 | 45.5 |

EXAMPLE III

Loading

This example demonstrates that the process is amenable to high loading of the PSV with slurry having high density. Two runs were carried out in the pilot circuit of Example I, using the large PSV 40 in one run and the smaller SSV 60 in the other run as the primary separation vessel. As the vessels had different surface areas, the runs involved "low" and "high" oil sand loading.

The relevant conditions and results are set forth in Table IV and V now following:

TABLE IV

PSV LOADING COMPARISON

| Parameter | | Pilot Vessel 40 as PSV | Pilot Vessel 60 as PSV |
|---|---|---|---|
| PSV DIAMETER | M | 5.18 | 3.66 |
| Oil Sand Rate (After Rejects) | t/h | 97.6 | 97.6 |
| Oil Sand Loading | t/h/ft2 | 0.44 | 0.91 |
| | t/h/m2 | 4.78 | 9.91 |
| Solids Loading | t/h/m2 | 4.06 | 8.42 |
| Bitumen Loading | t/h/m2 | 0.53 | 1.09 |

TABLE V

LOADING STUDY RESULTS - AVERAGE GRADE OIL SAND

| PSV | | Vessel 40 | Vessel 60 |
|---|---|---|---|
| Rejects (Based on Oil Sand Rate) | % | 2.5 | 3.0 |
| Rejects Bitumen Loss (Based on Oil Sand Feed) | % | 1.4 | 1.8 |
| PSV Bitumen Recovery (Based on PSV Feed) | % | 98.1 | 96.6 |
| PSV Froth Bitumen | % | 59.1 | 61.8 |
| PSV Froth Solids | % | 20.2 | 19.9 |
| PSV Froth Solids/Bitumen ratio | % | 0.34 | 0.32 |
| PSV Underflow Bitumen Loss (Based on PSV Feed) | % | 1.9 | 3.4 |
| PSV Underflow Bitumen | % | 0.1 | 0.2 |
| PSV Underflow Solids | % | 46.7 | 45.3 |

EXAMPLE IV

Low Grade Oil Sand

This example demonstrates that low grade oil sands can successfully be processed using the mixing/pipelining/flotation procedure with low temperature dense slurry, provided that:

Flotation aid chemicals (hereinafter "flotation aids") are used; and

The underflow tailings from the PSV are subjected to secondary recovery using submerged aeration and agitation.

Feedstock

The low grade oil sand feedstock contained 8.2% bitumen and had an average fines content of 33% (less than 44 $\mu$m).

Circuit

Figure 13:
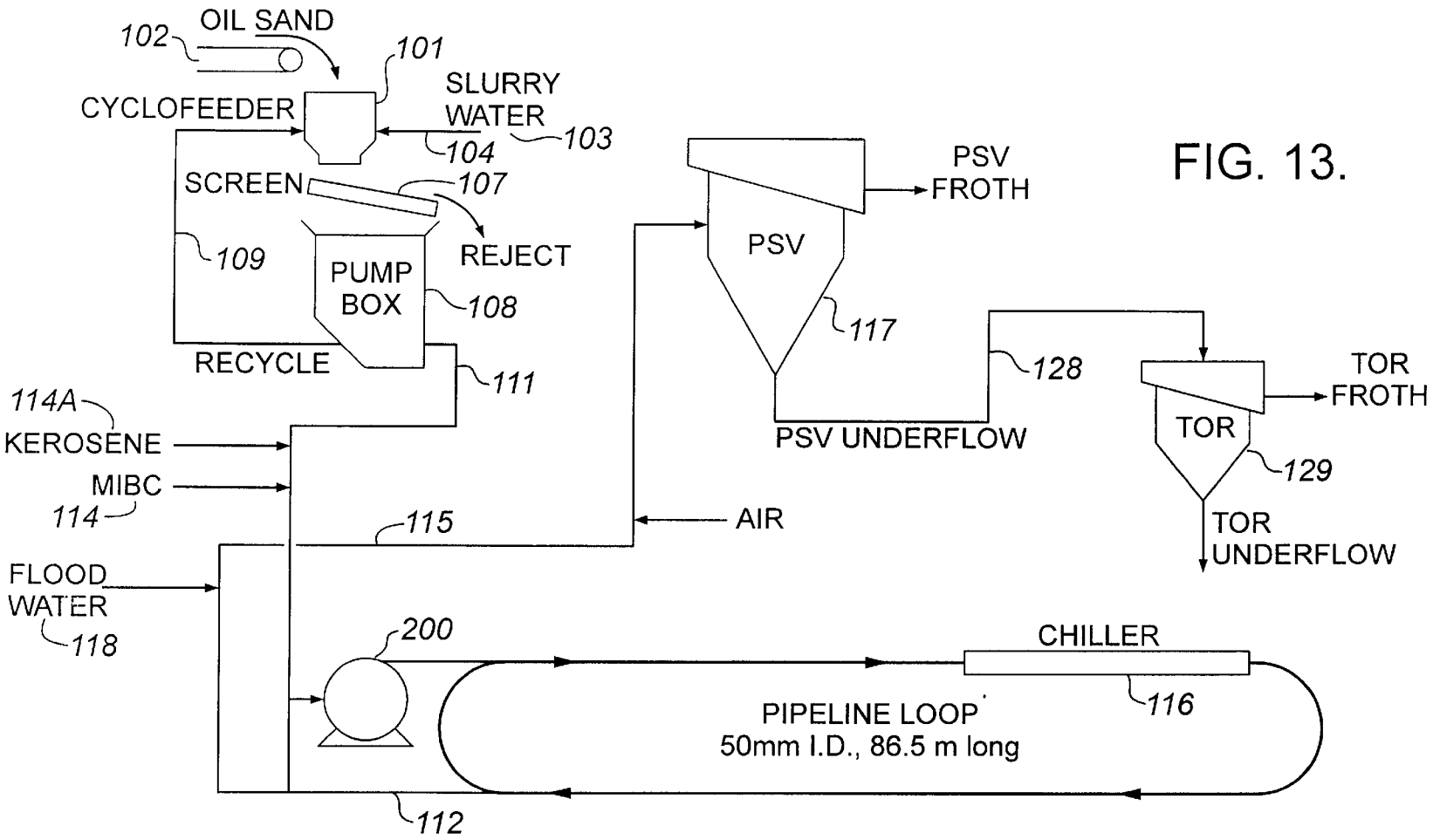
FIG. 13 is a schematic process flow diagram of the 2 tonne/hour pilot circuit (hereinafter "2 tph circuit") used to demonstrate the low grade version of the process.
Figure 14C:
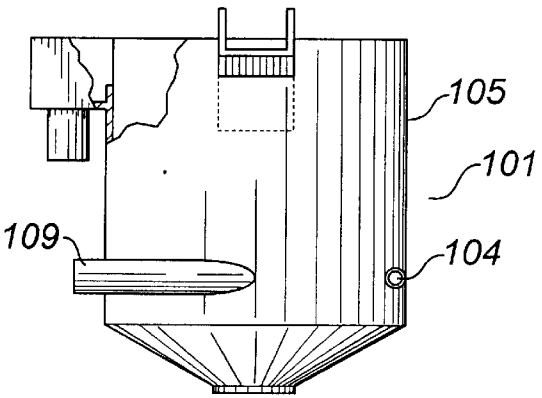
FIG. 14*c* is an end side view of the cyclofeeder of FIG. 14*a;*
Figure 14B:
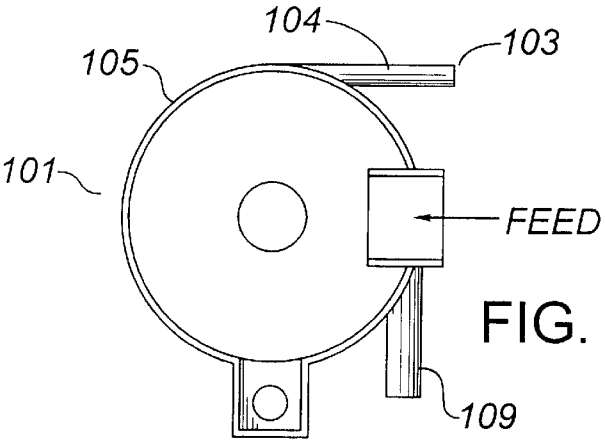
FIG. 14*b* is a top plan view of the cyclofeeder of FIG. 14*a;*
Figure 14A:
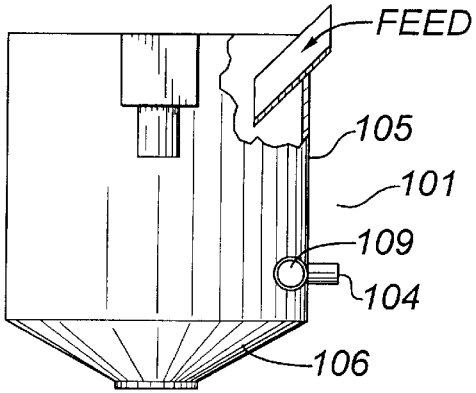
FIG. 14*a* is a side elevation of the cyclofeeder used in the 2 tph circuit.
Figure 15:
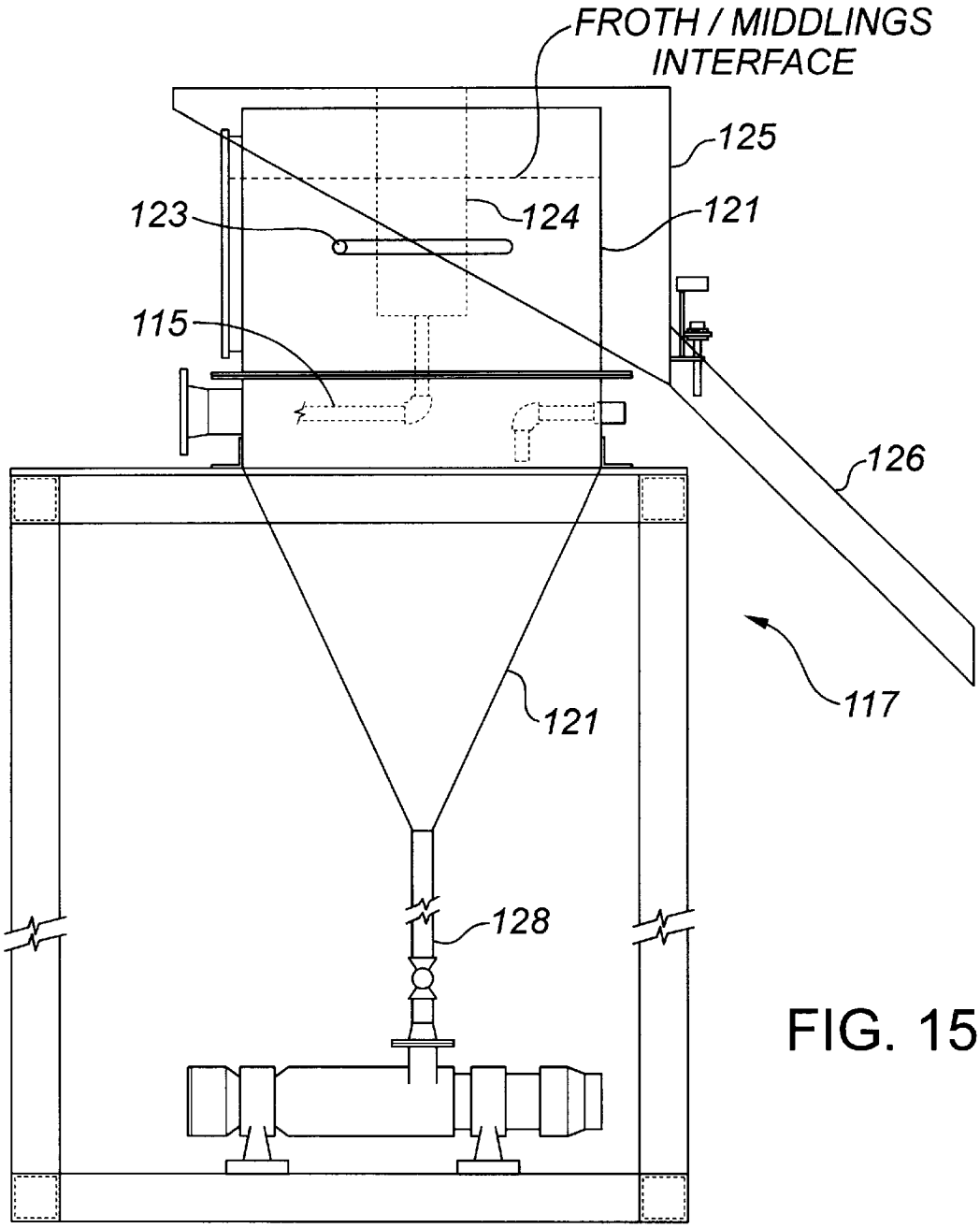
FIG. 15 is a side elevation of the PSV used in the 2 tph circuit.
Figure 16:
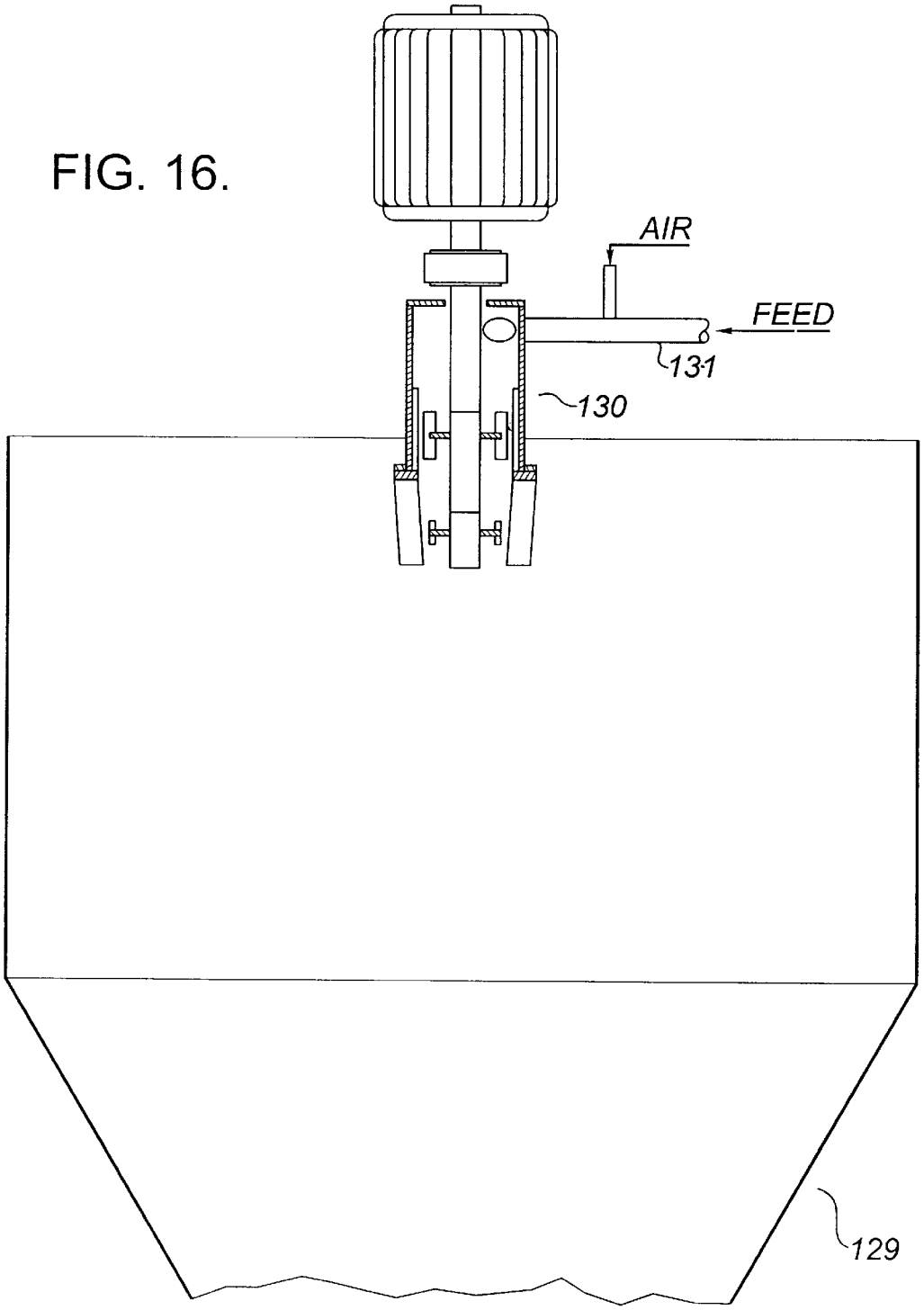
FIG. 16 is a partial side elevation of the secondary recovery vessel, referred to as the TOR (tailings oil recovery), used in the 2 tph circuit.

The feedstock was processed in a 1–2 tonnes/hour pilot circuit (see FIG. 13). This circuit comprised a vibrating grizzly (not shown) with 3"×4" openings, for removing oversize material from oil sand feed. The product was delivered into a cyclofeeder 101 by a conveyor 102. Water was introduced from a source 103 into the cyclofeeder through line 104. The cyclofeeder comprised a vessel 105 20 inches in diameter. The bottom cone 106 had an angle of 30 degrees with the horizontal. The cyclofeeder discharged onto a double deck vibrating screen 107. The top deck of the screen had 2 inch square openings and the lower deck had ⅜ inch square openings. The screened slurry dropped into a pump box 108. Part of the slurry in the pump box was pumped and recycled via the line 109 back into the cyclofeeder, to maintain the vortex therein. The remainder of the slurry in the pump box was pumped through line 111 to a pipeline loop 112. Flotation aids could be injected from sources 114, 114*a* into line 111. The pipeline loop was 2 inches in diameter and had a length of 47 meters. It comprised a chiller 116 for cooling the slurry if required. The slurry delivered through line 111 was pumped through the loop 112 by pump 200. The slurry leaving the loop was transferred through line 115 to the PSV 117. Flood water could be injected from a source 118 into line 115. Air at 75 psi could also be injected as bubbles into line 115 from a source 119. Aerated slurry residence time in the line 115 was about 20 seconds. The aerated slurry was introduced into the PSV 117 using a feedwell equipped with a chimney. The PSV 117 is shown in FIG. 15 and comprised a deep cone vessel 121 having a cylindrical upper section and conical lower section. The vessel 121 diameter was 800 mm. Hot water from a source 122 could be introduced through an underwash pipe 123 centrally located just beneath the expected froth/middlings interface. A central vent stack 124 was provided to allow excess air to escape and reduce turbulence in the vessel. Froth overflowed into a launder 125. The froth flowed down a trough 126 into primary froth weigh tanks (not shown). The PSV was operated as a two phase separator, producing a froth and a tailings underflow. The PSV underflow was fed through line 128 to a TOR vessel 129, for additional bitumen recovery. The TOR vessel is shown in FIG. 16. It was equipped with an agitator 130 supplied with air through a line 131, for producing air bubbles. It was also operated as a two phase separator, producing a froth and a tailings underflow. The TOR underflow was pumped to a tailings weigh tank (not shown) as the final tailings stream.

A series of runs were carried out wherein:

MIBC/kerosene dosage;

Air/slurry volume ratio; and

Underwash water/oil sand feed ratio, were varied, to determine their effect on bitumen recovery.

Conditions and Results

The low grade oil sand process target conditions were:

Pipeline slurry density—1.60 g/cc

Pipeline slurry temperature—25° C.

Pipeline residence time—8 minutes

Pipeline slurry velocity—3/ms

Oil sand target feed rate—1.5 tph

Froth underwash water target temperature—70° C.

TOR air addition rate—120 SCFH at 48 psi.

The remaining experimental conditions are set forth in Table VI, together with the run results.

The following observations can be made with respect to the experimental results:

The process was effective in achieving bitumen recovery as high as 90.76% (see run 2);

The use of chemical flotation aids (MIBC and kerosene) was found to be necessary for the low grade oil sand (see runs 11 and 2);

PSV, TOR and combined froth bitumen content were inversely related to air/slurry volume ratio (see runs 6, 9 and 10);

Increasing PSV froth underwash rate improved bitumen recovery (see runs 2 and 12).

EXAMPLE V

This example demonstrates that use of mechanical agitation in the secondary recovery TOR vessel gives better recovery than is experienced without agitation.

Table VII compares the average bitumen recoveries obtained with the 100 tph circuit of Example I with the 2 tph circuit of Example IV, using low grade oil sand as the feed. For the 100 tph circuit, the secondary separation vessel was a gravity settling vessel, whereas for the 2 tph circuit, the secondary separation vessel was a TOR vessel with a mechanical agitator. The results are set forth in Table VII.

TABLE VII

RECOVERY COMPARISON FOR 100 tph AND 2 tph CIRCUITS

| | Average Recovery, % | | |
|---|---|---|---|
| Circuit | PSV | SSV or TOR | Combined |
| 100 tph circuit | 52.7 | 7.6 | 60.3 |
| 2 tph circuit | 35.2 | 44.5 | 79.7 |

It will be noted that a significantly higher combined bitumen recovery was obtained from the 2 tph circuit than from the 100 tph circuit, because a significant amount of this recovery was achieved from the secondary recovery in the 2 tph circuit. The average secondary and combined bitumen recoveries were 8–12% and 60–68%, respectively, for the

TABLE VI

| | Operating Conditions | | | | PSV Froth | | | TOR Froth | | | Combined Froth | | |
|---|---|---|---|---|---|---|---|---|---|---|---|---|---|
| Run | PSV Final Feed Density, g/cc | Chem. Conc. Ppm | Air Ratio | Underwash Ratio | Recovery % | Bitumen Wt % | Solids Wt/% | Recovery % | Bitumen Wt % | Solids Wt % | Recovery % | Bitumen Wt % | Solids Wt % |
| 1 | 1.39 | 357 | 1.5 | 0.168 | 39.87 | 58.84 | 12.30 | 48.13 | 38.80 | 22.01 | 88.00 | 45.88 | 18.58 |
| 2 | 1.40 | 357 | 1.5 | 0.168 | 51.33 | 62.64 | 13.78 | 39.44 | 41.15 | 22.20 | 90.76 | 51.05 | 18.32 |
| 3 | 1.40 | 357 | 1.0 | 0.168 | 44.46 | 64.06 | 14.64 | 45.40 | 45.53 | 23.70 | 89.87 | 52.83 | 20.13 |
| 4 | 1.40 | 265 | 1.5 | 0.168 | 54.79 | 61.40 | 13.65 | 35.00 | 42.74 | 22.67 | 89.80 | 52.47 | 17.97 |
| 5 | 1.39 | 265 | 1.5 | 0.168 | 40.10 | 60.38 | 14.04 | 48.13 | 41.91 | 23.30 | 88.23 | 48.68 | 19.91 |
| 6 | 1.39 | 316 | 0.6 | 0.127 | 26.42 | 54.38 | 11.97 | 54.56 | 38.44 | 23.29 | 80.98 | 42.51 | 20.40 |
| 7 | 1.40 | 232 | 0.6 | 0.127 | 34.35 | 56.36 | 12.50 | 49.52 | 44.04 | 20.30 | 83.88 | 48.37 | 17.56 |
| 8 | 1.39 | 232 | 2.0 | 0.127 | 49.20 | 50.47 | 11.65 | 35.84 | 42.51 | 21.96 | 85.04 | 46.78 | 16.43 |
| 9 | 1.38 | 308 | 1.0 | 0.127 | 35.64 | 53.12 | 12.19 | 40.68 | 32.75 | 22.31 | 76.32 | 39.89 | 18.76 |
| 10 | 1.38 | 308 | 2.0 | 0.127 | 29.61 | 45.92 | 13.48 | 42.08 | 31.16 | 22.59 | 71.70 | 35.93 | 19.65 |
| 11 | 1.39 | 0 | 2.0 | 0.127 | 20.02 | 44.27 | 12.35 | 44.35 | 33.71 | 20.89 | 64.39 | 36.41 | 18.70 |
| 12 | 1.38 | 347 | 1.5 | 0.127 | 33.93 | 45.12 | 10.39 | 38.21 | 31.79 | 21.86 | 72.14 | 36.92 | 17.45 |
| 13 | 1.39 | 400 | 1.5 | 0.127 | 32.56 | 45.90 | 10.09 | 42.95 | 32.56 | 21.39 | 75.50 | 37.22 | 17.44 |
| 14 | 1.40 | 400 | 1.5 | 0.127 | 31.84 | 45.51 | 10.30 | 43.60 | 32.64 | 21.71 | 75.45 | 37.06 | 17.79 |
| 15 | 1.40 | 424 | 1.5 | 0.127 | 29.09 | 47.79 | 11.18 | 46.32 | 33.51 | 21.00 | 75.41 | 37.88 | 18.00 |
| 16 | 1.40 | 424 | 1.5 | 0.127 | 28.40 | 46.67 | 11.08 | 45.49 | 32.42 | 22.35 | 73.89 | 36.73 | 18.94 |

100 tph circuit and 35–45% and 75–80%, respectively, for the 2 tph circuit.

The embodiments of the invention in which an exclusive property or privilege is claimed are defined as follows:

1. A method for recovering bitumen from oil sand, comprising:

dry mining oil sand from a deposit at a mine site;

mixing the oil sand near the mine site with water to produce a high density, low temperature slurry containing bitumen, sand, water and entrained air, the slurry having a density in the range of about 1.4 to 1.65 g/cc and a temperature in the range of about 20 to 35° C.;

pumping the slurry through a pipeline to a primary separation vessel;

introducing the slurry from the pipeline into the vessel and temporarily retaining it therein so that separate layers of bitumen froth, middlings and sand tailings are formed; and separately removing bitumen froth, middlings and sand tailings from the vessel.

2. The method as set forth in claim 1 comprising:

adding air to the slurry as it moves through the pipeline to form an aerated slurry.

3. The method as set forth in claim 2 comprising:

venting excess air from the slurry as it is being introduced into the vessel.

4. The method as set forth in claim 3 comprising:

diluting the slurry with water prior to introducing it into the vessel, if required, to ensure that its density is less than about 1.5 g/cc.

5. The method as set forth in claim 4 comprising:

maintaining the area loading of slurry to the vessel greater than about 4.78 t/h/m$^2$.

6. The method as set forth in claim 5 wherein:

the pipeline has sufficient length so that the retention time therein is at least 4 minutes.

7. The method as set forth in claim 6 wherein the area loading of slurry to the vessel is maintained within the range of about 4.78 to 9.91 t/h/m$^2$.

8. The method as set forth in claim 5 comprising:

heating bitumen in the vessel by adding heated water as an underwash layer immediately beneath the bitumen froth layer.

9. The method as set forth in claim 8 wherein:

the amount of air added to the slurry in the pipeline is about 1 to 2.5 volumes of air per volume of slurry.

10. The method as set forth in claims 1, 2, 3, 4, 5, 6, 7, 8 or 9 wherein the oil sand is of at least about average grade.

11. The method as set forth in claims 1, 2, 3, 4, 5, 6, 7, 8 or 9 wherein the oil sand is of at least about average grade, the slurry is moved through the pipeline by a plurality of pumps spaced along its length and the added air is introduced into the slurry after the last pump and prior to the vessel.

12. The method as set forth in claim 3 comprising:

maintaining the area loading of slurry to the vessel greater than about 4.78 t/h/m$^2$.

13. The method as set forth in claim 12 wherein:

the pipeline has sufficient length so that the retention time therein is at least 4 minutes.

14. The method as set forth in claim 13 wherein the area loading of slurry to the vessel is maintained within the range of about 4.78 to 9.91 t/h/m$^2$.

15. The method as set forth in claim 14 comprising:

heating bitumen in the vessel by adding heated water as an underwash layer immediately beneath the bitumen froth layer.

16. The method as set forth in claims 12, 13, 14 or 15 wherein:

the amount of air added to the slurry in the pipeline is about 1 to 2.5 volumes of air per volume of slurry.

17. The method as set forth in claims 12, 13, 14 or 15 wherein the oil sand is of at least about average grade.

18. The method for recovering bitumen from low grade oil sand, comprising:

dry mining oil sand from a deposit at a mine site;

mixing the oil sand near the mine site with water to produce a high density, low temperature slurry containing bitumen, sand, water and entrained air, the slurry having a density in the range of about 1.4 to 1.65 g/cc and a temperature in the range of about 20 to 35° C.;

pumping the slurry through a pipeline to a primary separation vessel;

adding air and a flotation aid to the slurry, the air being added to the slurry as it moves through the pipeline, to form an aerated slurry;

introducing the aerated slurry from the pipeline into the vessel and temporarily retaining it therein so that separate layers of bitumen froth, middlings and sand tailings are formed; and separately removing bitumen froth, middlings and sand tailings from the vessel.

19. The method as set forth in claim 18 comprising:

venting excess air from the slurry as it is being introduced into the vessel.

20. The method as set forth in claim 19 comprising:

diluting the slurry with water prior to introducing it into the vessel, if required, to ensure that its density is less than about 1.5 g/cc.

21. The method as set forth in claim 20 comprising:

maintaining the area loading of slurry to the vessel greater than about 4.78 t/h/m$^2$.

22. The method as sets forth in claim 21 wherein:

the pipeline has sufficient length so that the retention time therein is at least 4 minutes.

23. The method as set forth in claim 22 wherein the area loading of slurry to the vessel is maintained within the range of about 4.78 to 9.91 t/h/m$^2$.

24. The method as set forth in claim 21 comprising:

heating bitumen in the vessel by adding heated water as an underwash layer immediately beneath the bitumen froth layer.

* * * * *